United States Patent [19]

Sekimoto et al.

[11] Patent Number: 4,518,261

[45] Date of Patent: May 21, 1985

[54] EQUIPMENT FOR DISSOLVING POLYACRYLAMIDE POWDER FOR OBTAINING AN AQUEOUS SOLUTION THEREOF FOR ENHANCED OIL RECOVERY

[75] Inventors: Yukihiko Sekimoto, Fujimi; Osamu Okamoto, Tokyo, both of Japan

[73] Assignee: Nitto Kagaku Kogyo Kabushiki Kaisha, Tokyo, Japan

[21] Appl. No.: 478,884

[22] Filed: Mar. 25, 1983

[30] Foreign Application Priority Data

Mar. 31, 1982 [JP] Japan ..... 57-52554

[51] Int. Cl.[3] ..... B01F 15/02

[52] U.S. Cl. ..... 366/150; 366/177; 366/196

[58] Field of Search ..... 366/10, 13, 14, 15, 366/139, 150, 155, 176, 177, 182, 183, 184, 190, 191, 196, 290, 291, 344, 349; 222/227, 236, 242; 175/268, 270

[56] References Cited

U.S. PATENT DOCUMENTS

| | | | |
|---|---|---|---|
| 3,010,932 | 11/1961 | Stoveken | 366/150 |
| 3,263,866 | 8/1966 | Proctor | 222/242 |
| 3,782,695 | 1/1974 | Sandiford | 366/139 |
| 3,881,702 | 5/1975 | McIver | 366/177 |
| 3,998,597 | 12/1976 | Forrest | 366/177 |
| 4,007,921 | 2/1977 | Zingg | 366/10 |

FOREIGN PATENT DOCUMENTS 93740 7/1980 Japan .

35734 7/1980 Japan .

*Primary Examiner*—Robert W. Jenkins

*Attorney, Agent, or Firm*—Robert E. Burns; Emmanuel J. Lobato; Bruce L. Adams

[57] ABSTRACT

Equipment for dissolving polyacrylamide powder to obtain an aqueous solution thereof for enhanced oil recovery comprises first and second powder storage tanks for storing polyacrylamide powder under nitrogen atmosphere;

a gas conveyor unit for carrying the polyacrylamide powder from the first storage tank to the second storage tank by nitrogen gas flow;

a constant powder supply unit for receiving the polyacrylamide powder from the second storage tank, metering the powder, and sending the metered powder to a powder dispersion unit for dispersing in water the polyacrylamide powder.

A first liquid supply unit sends the dispersion or solution of polyacrylamide powder obtained from the powder dispersion unit to a dissolution tank for completing dissolution of the polyacrylamide;

and a second liquid supply unit transfers the polyacrylamide solution from the dissolution tank to a solution storage tank for storing the polyacrylamide solution.

A filtration unit is connected in the liquid supply line between the dissolution tank and the solution storage tank; and a nitrogen gas supply system maintains the interiors of these units filled with nitrogen gas at a pressure higher than atmospheric pressure.

1 Claim, 6 Drawing Figures

EQUIPMENT FOR DISSOLVING POLYACRYLAMIDE POWDER FOR OBTAINING AN AQUEOUS SOLUTION THEREOF FOR ENHANCED OIL RECOVERY

BACKGROUND OF THE INVENTION

This invention relates to a method for enhanced oil recovery from underground oil-bearing formations. More particularly, this invention relates to a dissolution equipment for producing a stable aqueous solution of polyacrylamide powder for use in enhanced oil recover.

In general, the so-called primary method of oil recovery has been practiced for many years as a method for recovering oil from underground oil reservoirs and comprises finding underground oil-reservoirs by exploration of oil, establishing oil recovery plants and recovering crude oil by free flowing or pumping until an economical oil recovery rate is obtained. Recently, the techniques for exploring oil reservoirs have been greatly developed, whereby it has become possible to analyze the state of oil reservoirs more exactly. Together with this development a method for enhanced oil recovery which comprises sweeping crude oil by injecting a fluid into underground oil-bearing formation which are in a state of decreased oil recovery after primary recovery has been conducted widely.

The fluid to be used in such methods for enhanced oil recovery is generally water, and thus such methods have been called "water flooding". In this connection, an aqueous solution of a water-soluble polymer has been sometimes used as the fluid thereby to control the mobility of the fluid in the oil-bearing formations. Polyacrylamide has been popularly used as a desirable polymer.

The polyacrylamide to be used for this purpose should be of an ultra-high molecular weight. One of the methods for obtaining the aqueous solution thereof is to dissolve in water the polyacrylamide powder, which is ordinarily packaged in a paper bag or the like and delivered to consumers. However, the operation of dissolving the polymer is not always easy because of reasons such as the ultra-high molecular weight of the polyacrylamide and the necessity of the resulting solution to withstand severe conditions in the oil reservoir. More specifically, polyacrylamide powder has hitherto been dissolved in water by opening bags containing it, pouring the powder into a hopper, supplying the powder to a dispersion vessel by means of a screw-type feeder, and dissolving the powder by agitation to produce an aqueous solution thereof.

This procedure has been accompanied by several problems, however, such as contamination upon opening the bags by, for example, chips of the materials of bags, contamination with oxygen present in the voids among the powder, formation of lumps due to moisture, inconstant supply due to formation of bridge and flash which are often encountered in a screw-type feeder, and formation of lumps and poor dispersion in liquid due to upward blowing (for lack of a means for blowing gas downwards). Thus, the aqueous polymer solution thus prepared is totally unfit for the mobility-controlling fluid because of contamination of foreign substances, deterioration due to oxygen, formation of insolubles, and unstable concentration of polymer, as well as other reasons. In fact, when the resulting solution or a solution obtained by dilution thereof to a desired concentration was injected into an underground oil-bearing formation, it has been often found that the polymer does not function as desired, and also plugging is caused to stop production of crude oil.

Although all of these problems are serious, precaution should be especially paid to the deterioration due to oxygen when an aqueous solution of polyacrylamide is used for sweeping oil. More specifically, the oil reservoirs where the polymer solution works are often under a high temperature and pressure, and thus the deterioration of the aqueous solution of polyacrylamide injected thereinto is markedly caused to occur when oxygen is dissolved in the solution. As a result, the viscosity of the solution is substantially decreased to a level as low as that of the injection water, whereby the purpose for using a viscous solution cannot be achieved.

In general, oxygen is not present in reservoirs. As long as the aqueous solution is prepared as described above, however, it is difficult to avoid the presence of the dissolved oxygen which causes such deterioration of polymer solution in the reservoirs. Even when an attempt is made to maintain the system for preparing the solution under a nitrogen gas atmosphere, it is not easy to apply the nitrogen atmosphere to all of the equipment units. Even if such a modification is possible, the oxygen in the voids among polyacrylamide powder cannot be removed by simply placing the system for producing the solution under a nitrogen gas atmoshere.

Furthermore, the steps of metering, supply and dissolution are not always easy because the substance to be dissolved is polyacrylamide powder. Since the polyacrylamide powder is apt to undergo caking when compressed, the metering and supply which cause compression (for example by means of a screw-type feeder) are not suitable as mentioned above. Because caking of polyacrylamide power readily takes place, especially when it absorbs moisture, the metering and supply systems accompanying compression which are placed before the dissolution step are especially unfit for this purpose. Furthermore, a homogeneous solution cannot be obtained with formation of "lump" if water is added to the polyacrylamide powder for dissolution thereof, unless extremely vigorous agitation is conducted.

SUMMARY OF THE INVENTION

It is an object of the present invention to solve the above described problems, and the invention aims to achieve this object by providing an equipment for dissolution wherein the specific equipment units are assembled integrally.

The equipment for dissolving polyacrylamide powder to obtain an aqueous soltuion thereof for enhanced oil recovery in accordance with the present invention comprises the following equipment units (A) through (K):

(A) a first powder storage tank for storing polyacrylamide powder under a nitrogen atmosphere;

(B) a second powder storage tank for storing polyacrylamide powder under a nitrogen atmosphere;

(C) a gas conveyer unit for carrying the polyacrylamide powder from the first storage tank to the second storage tank by nitrogen gas;

(D) a constant powder supply unit which receives the polyacrylamide powder to be supplied from the second storage tank, meters the powder and sends the powder to the next step; wherein said constant powder supply unit comprises a vertical cylinder to receive the powder, a bottom plate which closes the bottom portion of the cylinder and has an opening portion to allow discharge of a small amount of the powder, a partition plate having an opening portion to allow falling of a small amount of the powder which partition plate is disposed within the cylinder parallel to the bottom plate and over the bottom plate, a driving shaft disposed coaxially in the central portion of the cylinder through the bottom plate and the partition plate, a plurality of radial division plates which are fixed to the driving shaft in the cylindrical space defined by the bottom plate and the partition plate and are designed to rotate in sliding contact with the upper surface of the bottom plate and the lower surface of the partition plate as well as the inner surface of the cylinder, and a rotary powder agitation vane which is fixed to the driving shaft at the upper portion of the partition plate within the cylinder, the opening portion of the bottom plate for discharging the powder and the opening portion of the partition plate for allowing falling of the powder being provided apart from the driving shaft, and the shapes and positions of these opening portions being so designed that these opening portions do not lie one over another in the vertical direction, communication between these portions being prevented by the division plates;

(E) a powder dispersion device for dispersing in water the polyacrylamide powder discharged from the discharging opening portion of the bottom plate of the constant powder supply device, said powder dispersion device comprising a vessel, a water supply pipe connected to a side portion of the vessel for sending water under pressure into the vessel, a powder supply pipe connected to the upper portion of the vessel for supplying the powder into the vessel, a powder and water discharge pipe having a funnel-shaped structure of suitable height from the bottom portion of the vessel and being installed coaxially with the powder supply pipe, and an overflow pipe connected to the vessel for discharging water supplied in excess; the vessel and the water supply pipe being so designed that water whirls around the discharge pipe within the vessel;

(F) a first liquid transfer device for transferring the dispersion or solution of polyacrylamide powder obtained from the powder dispersion device;

(G) a dissolution tank for receiving the dispersion or solution of polyacrylamide powder thus transferred by the first liquid transfer device and for completing dissolution of the polyacrylamide;

(H) a second liquid transfer device for transferring the polyacrylamide solution from the dissolution tank;

(I) a solution storage tank for storing the polyacrylamide solution thus transferred by the second liquid transfer device;

(J) a filtration device provided in the liquid supply line between the dissolution tank and the solution storage tank; and (K) a nitrogen gas supply system for maintaining the interiors of said units, wherein the polyacrylamide powder or the dispersion or solution thereof is present, filled with nitrogen gas at a pressure higher than atmospheric pressure.

DETAILED DESCRIPTION OF THE INVENTION

1. Polyacrylamide

The powdery polyacrylamides to be used in the present invention are at least one of such polyacrylamides in powder form having a molecular weight ordinarily in the range of about $1\times10^6$ to about $2\times10^7$ selected from acrylamide homopolymers partially-hydrolyzed acrylamide homopolymers, acrylamide copolymers, partially-hydrolyzed acrylamide copolymers and mixtures thereof. The type, molecular weight, and other characteristics of the polyacrylamides are selected in accordance with the conditions of the oil reservoirs and other factors. The particle size of the powder is in the range of about 200 to about 14 mesh. Hereinafter the polyacrylamide is sometimes referred to as PAA.

2. Entire equipment

Figure 1:
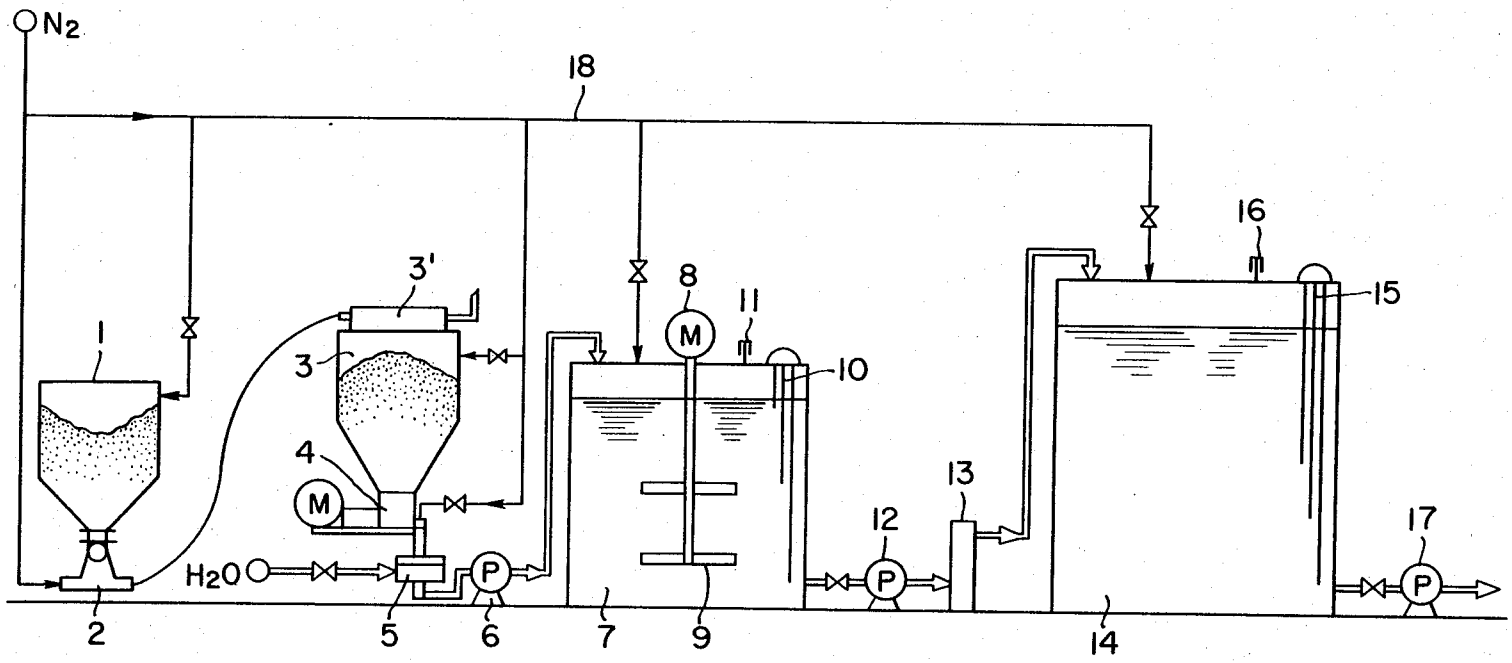
FIG. 1 is an elevational view in form of a flow chart showing the arrangement of equipment units in schematic an example of the equipment of the present invention.

The equipment of the present invention comprises a number of equipment units as schematically shown in FIG. 1.

PAA powder stored in a first powder storage tank 1 is sent to a second powder storage tank 3 by means of a gas-conveyor device 2 using nitrogen gas.

The storage tank 3 is equipped with a constant powder supply device 4. The PAA powder discharged from the supply device 4 is sent to a powder dispersion device 5, where the powder is dispersed, and where at least some of the PAA powder is dissolved.

The dispersion or solution of the PAA powder in the dispersion device 5 is sent by means of a first liquid transfer device 6 to a dissolution vessel 7, where any PAA powder possibly remaining undissolved is completely dissolved.

The PAA solution thus obtained is sent to a solution tank 14 by means of the second liquid transfer device 12. A filtration device 13 is installed at the upstream or downstream position and preferably at the downstream side of the liquid transfer device 12, where any insolubles which may be present are removed.

Nitrogen gas is supplied to these unit equipment components from a nitrogen gas supply system 18, so that the interiors of the unit components wherein the PAA powder or the dispersion or solution thereof is present can be under nitrogen gas pressure higher than atmospheric pressure.

The unit components and piping therefor are preferably formed from materials whose surfaces which the PAA powder or its dispersion or solution contacts will not cause chemical deterioration of the PAA (e.g., from synthetic resins).

The concentration of the PAA solution produced by this equipment is optional but is ordinarily of the order of about 0.005 to about 2% by weight.

3. Unit equipment components (1) First powder storage tank (1)

This storage tank can be any design provided that the interior of the tank can be kept under an atmosphere of nitrogen gas and the powder stored in the tank can be discharged outside by a gas-conveyor device.

According to a preferred embodiment of the present invention, this storage tank is of a container type, which is used to transport the PAA powder from a PAA powder supplier to oil wells where the powder is to be used.

(2) Gas-conveyor device (2)

The device to be used in the present invention is essentially the same as conventional ones except that the conveyor gas is nitrogen gas and the substance to be conveyed is PAA powder. A specific example of the pipe line through which the PAA powder is passed is a flexible hose of rubber or the like.

(3) Second powder storage tank (3)

Because the second storage tank is provided for the purpose of accommodating the PAA powder conveyed by the action of nitrogen gas, the tank should have the functions of separating the PAA powder from the conveyor gas and discharging the conveyor gas outside of the tank.

For this purpose, it is preferable that the tank function as a cyclone. More specifically, the tank is preferably in the form of a vertical cylinder or a cone which is so adapted that the powder and nitrogen gas sent from the gas-conveyor device 2 enter the tank tangentially and whirl within the tank. Fine PAA powder still floating in the gas is removed by a suitable filtration device (3') such as a bag filter, and only the nitrogen gas (together with desorbed oxygen) is discharged outside.

The PAA powder can be conveyed intermittently to the second storage tank 3. In this case, it is preferable to activate the gas-conveyor device 2 by installing means for detecting the amount of PAA powder in the tank, for example, a powder-level meter for detecting the presence or level of powder accumulation from the resistance imparted to rotating vanes.

(4) Constant powder supply device (4)

Figure 2:
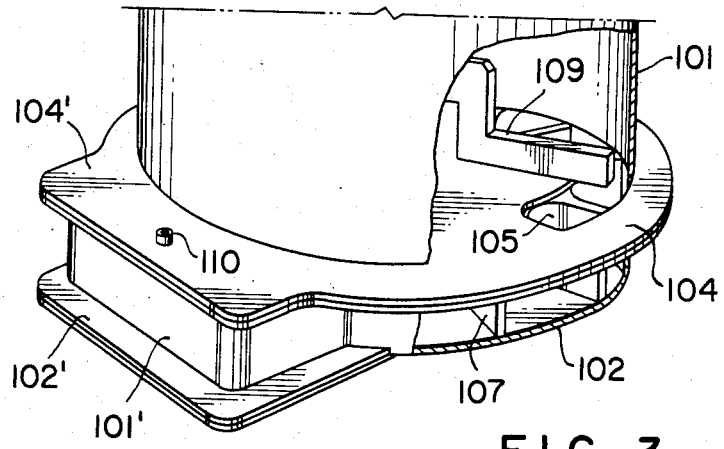
FIGS. 2, 3 and 4 are a perspective view (FIG. 2), an elevation view, in vertical section (FIG. 3), and a plan view (FIG. 4) respectively showing an example of a constant powder supply unit which constitutes a main unit of the present equipment.
Figure 3:
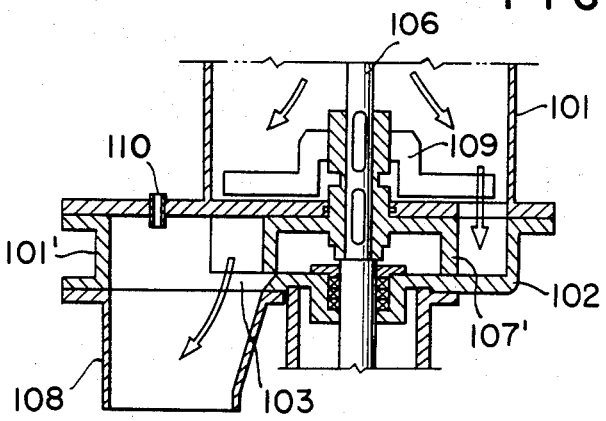
Figure 4:
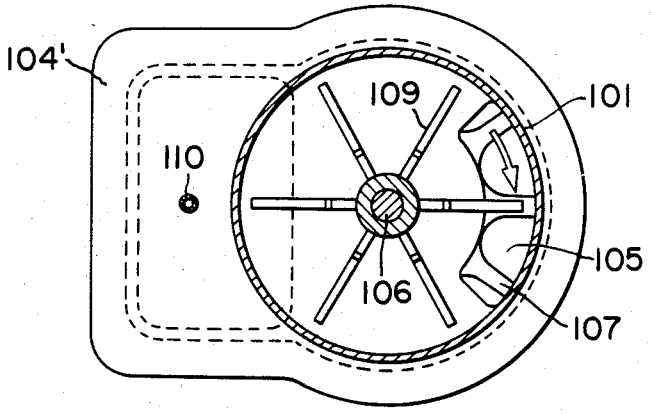

One example of a constant powder supply device suitable for use in the present invention is shown in FIG. 2 (perspective view), FIG. 3 (elevation view, in vertical section) and FIG. 4 (plan view).

In FIG. 2, the portion 101 is a vertical cylinder to receive powder from the tank (3) (FIG. 1) and is ordinarily connected directly to the lower portion of the tank (3) (cf. FIG. 1).

The bottom portion of the cylinder 101 is closed by a bottom plate 102. The bottom plate 102 is provided with an opening portion 103 spaced apart from a driving shaft 106 (cf. FIG. 3), that is, adjacent to the inside wall surface of the cylinder, as described hereinafter with respect to FIG. 2.

Inside of the cylinder 101, a partition plate 104 is provided over the bottom plate 102 in parallel therewith and spaced-apart therefrom. An opening 105 is provided in the partition plate 104 spaced apart from the driving shaft 106 so that a small amount of powder falls down from the cylinder 101.

The bottom plate 102 and the partition plate 104 may project to the outside of the cylinder (102', 104') as shown in the figures. Furthermore, the bottom portion of the cylinder 101 may have a projecting portion 101' in accordance with the contour of these two plates. The projecting portion 101' also serves to cover an opening portion 103 of the bottom plate projecting outside of the cylinder.

As shown in FIGS. 3 and 4, a driving shaft 106 is installed at the center of the cylinder 101 through the bottom plate 102 and the partition plate 104. A plurality of radial division plates 107 (cf. FIG. 2) are fixed to the driving shaft 106 and are adapted to rotate in sliding contact with the top surface of the bottom plate 102 and the lower surface of the partition plate 104 as well as with the inner surface of the cylinder. The radial division plates 107 may be secured directly to the driving shaft 106, but it is preferred that they be implanted in a hub 107' of the driving shaft 106 because the accumulation of powder in the vicinity of the shaft 106 is not desirable. More specifically, the space defined by two adjacent division plates 107, the inside of the cylinder 101, the top surface of the bottom plate 102 and the lower surface of the partition plate 104 functions as a cell for accommodating the PAA powder falling through the opening portion 105 of the partition plate, and the PAA powder in the cell is carried to the opening portion 103 of the bottom plate 102 by the rotation of the driving shaft, the opening portions 105 and 103 being positioned apart from the driving shaft 106.

As shown in FIGS. 3 and 4, the shapes and positions of the opening portion 103 of the bottom plate and the opening portion 105 of the partition plate 104 are selected so that the opening portions do not lie one over another in the vertical direction or in the direction parallel to that of the driving shaft 106, and so that, more typically, the opening portions lie symmetrically with respect to the driving shaft, communication between these openings being prevented by a division plate 107. As a result, the PAA powder is supplied through the opening 105 of the partition plate 104 into the cell (the space defined in the bottom plate 102—partition plate 104—cylinder 101 by two adjacent division plates 107 and preferably by the outer surface of the hub 107', as described hereinabove), by gravity without being compressed and regardless of the pressure at the opening portion 103 of the bottom plate 102. The PAA powder is then carried by the rotation of the division plates to the opening portion 103 of the bottom plate via a completely closed region where the two opening portions are not overlapped, and the PAA powder is thereafter discharged through a chute 108.

Stirring vanes 109 are fixedly mounted on the driving shaft 106 above the partition plate 104 and within the cylinder 101 to prevent the PAA powder within the cylinder 101 from bridging and assuming other poor flowing conditions. As a modification the driving shaft can also be designed to project into the interior of the second powder storage tank 3 connected to the upper portion of the constant powder supply unit, where other stirring vanes are provided to conduct stirring within the storage tank 3.

The PAA powder discharged from the opening portion 103 of the bottom plate 102 may be sent by gravity to the next dispersion step but is preferably sent by means of nitrogen gas to the succeeding step. Thus, it is preferable that nitrogen gas be applied from a nitrogen-blowing part 110 at a suitable position, for example, at the projecting portion 104' of the partition plate 104. The pressure at the opening 103 of the bottom plate 102 will become larger by blowing nitrogen than that at the opening 105 of the partition plate 104 but the PAA powder can be supplied into the cell without trouble because the two opening portions are not communicative.

A constant powder supply unit having such a construction is indicated in Japanese Patent Laid-open Publication No. 93740/1980.

(5) Powder dispersion unit (5)

Figure 5:
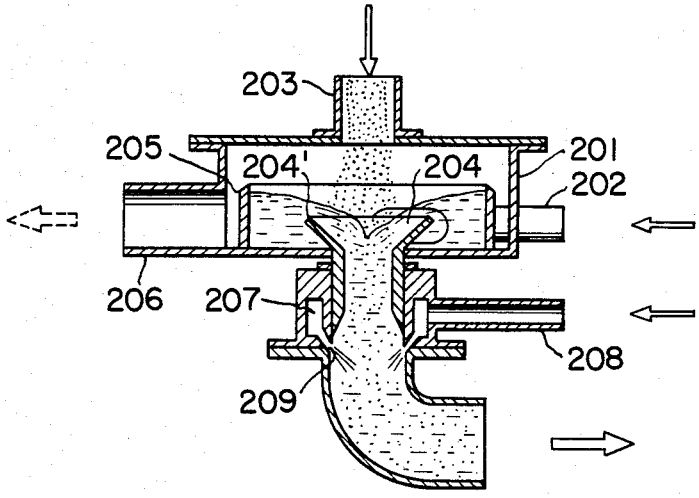
FIG. 5 is an elevation view, in vertical section, showing an example of a powder dispersion unit which constitutes a main unit of the present equipment
Figure 6:
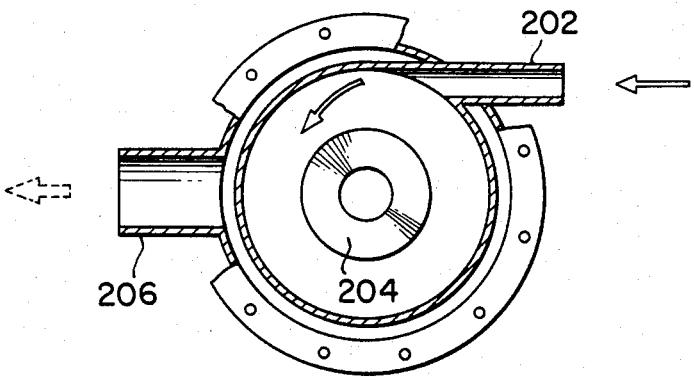
FIG. 6 is a plan view orthogonal to FIG. 5, partly in horizontal section.

An example of a powder dispersion unit suitable for use in the present invention is shown in FIG. 5 (vertical section) and FIG. 6 (partially sectioned plan view).

As shown in FIGS. 5 and 6, the powder dispersion unit has at its upper part a vessel 201 provided at its side with a water supply pipe 202, through which water can be supplied under pressure. The vessel 201 also has a vertical powder supply pipe 203 at its top center part and an upstanding powder and water discharge pipe 204 of a funnel shape of suitable height at its bottom portion, the discharge pipe 204 and the powder supply pipe 203 being coaxially installed relative to the vessel 201.

It is necessary that the vessel 201 and the water supply pipe 202 be so constituted that water is whirled within the vessel about the discharge pipe. One example of such a construction is shown in FIGS. 5 and 6. A circular division plate 205 of greater height than the upper rim 204' of the discharge pipe 204 is installed within the vessel 201 coaxially with the discharge pipe 204, and the water supply pipe 202 is so connected to the vessel 201 that water is sent into the vessel 201 under pressure in the tangential direction relative to the circular division plate 205. By this construction, the water thus sent under pressure is whirled within the circular division plate 205 and discharged from the funnel-shaped discharge pipe 204. Thus, negative pressure is generated in the vicinity of the funnel-shaped opening 204', and the PAA powder from the supply pipe 203 is sucked into the discharge pipe 204. Because the inside surface of the funnel-shaped opening portion is covered with the whirling falling water, the PAA powder is well dispersed by the energy of whirling water and discharged to the next step without directly contacting or sticking to the vessel.

Another example of a structure for producing such a whirling discharge is that wherein the circular inner surface of the vessel 201 is utilized directly to whirl water without the use of a circular division plate 205. Such a structure is disclosed in Japanese Utility Model Laid-open Publication No. 35734/82.

Referring again to FIGS. 5 and 6, the vessel 201 is provided with an overflow pipe 206 because the flow rate of the water sent under pressure into the vessel 201 is sometimes greater than the flow rate of water discharged from the discharge pipe 204, and also the water is caused to sometimes overflow from the circular division plate by the action of vigorous whirling. In the arrangement wherein the vessel 201 itself is used as means for whirling water without the circular division plate 205, an overflow pipe can be provided near the upper part of the vessel 201 (cf. Japanese Utility Model Laid-open Publication No. 35734/82, referred to above).

The energy and flowing condition of the water which is whirled while generating negative pressure and discharged from the discharge pipe 204 is normally sufficient to disperse the PAA powder in the water. If necessary, however, the PAA powder can be dispersed more completely by adding additional water under pressure at a downstream position of the discharge pipe 204.

Means for adding additional water under pressure is shown also in FIG. 5. More specifically, an annular room 207 is provided to surround the discharge pipe 204 at the downstream position of the funnel-shaped opening portion 204' of the discharge pipe, and a water supply pipe 208 is connected thereto to supply water under pressure in the tangential direction into the annular room 207. The discharge pipe 204 has continuous or discontinuous spaces 209 bored around the pipe so that water is added under pressure from the annular room 207. Thus, additional water from the water supply pipe 208 is whirled and sent under pressure into the discharge pipe.

The water to be supplied, of course, should be deoxygenated water. If necessary, the water may be freed of suspended particles or may contain bactericides, corrosion inhibitors, chelating agents or the like in the form of a solution.

(6) The first liquid transfer device (6)

The liquid transfer device 6 may be of any reasonable type provided that attention is paid to the fact that the liquid obtained by the powder dispersion device 5 is a liquid of high viscosity which may possibly contain remaining PAA powder. It is preferred that the liquid transfer device 6 be a device exhibiting low shear force with respect to the PAA molecules, and specifically the device is represented by a Mono pump or the like.

(7) Dissolution tank (7)

The PAA dispersion or solution thus obtained is sent to the dissolution tank 7, where dissolution of the PAA powder is completed.

The dissolution tank 7 is a sealed vessel having a required capacity and is provided with a suitable stirring means such as a paddle agitator 9 driven by a motor 8, a liquid level gage 10, and a vent 11.

It is preferred that the paddle agitator have one to about three tiers of stirring vanes, and that the length of each vane be nearly as long as the inner diameter of the dissolution tank. Furthermore, the peripheral velocity of the vane is of the order of about 0.5 to about 3 m/sec., preferably about 0.8 to about 2 m/sec. When the velocity is less than about 0.5 m/sec., the time for dissolution is excessively long. If the peripheral velocity is more than about 3 m/sec., it is apt to cause deterioration of the PAA molecules by shearing action. The time for dissolution is in the range of the order of about 15 minutes to about 4 hours.

(8) The second liquid transfer device (12) and filtration device (13)

The liquid transfer device 12 may be of a type identical with or different from the above described first liquid transfer device 6.

The filtration device 13 can be a strainer having openings of about 140 to about 35 mesh, preferably about 100 to about 50 mesh.

(9) The liquid storage tank (14) and liquid supply unit (17)

The storage tank 14 for storing the aqueous PAA solution thus obtained is substantially the same as the dissolution tank 7 described above except that no stirring means is provided therein. A stirring means can be installed in this storage tank if necessary. The liquid storage tank 14 has a liquid level gauge 15 and a vent 16 similar to those of the dissolution tank 7.

The liquid transfer device 17 may be of a type idential with or different from the above mentioned liquid transfer device 12.

(10) Nitrogen gas supply system (18)

The nitrogen gas supply system 18 is a means for maintaining the interiors of the above described unit components of the equipment wherein the PAA powder or the dispersion or solution thereof is present under nitrogen gas pressure higher than atmospheric pressure. This system 18 comprises a suitable nitrogen gas supply source and piping, which may also be provided with vent means as necessary.

4. Experiments

The filtration factor to be determined in the following examples is obtained from the following expression based on the time required for passing the following volumes of a PAA polymer solution through a filter 47 mm in diameter, "Nuclepore Filter" (trade name of Nuclepore Corp., USA) having a pore size of 1 micron.

$$\text{Filtration Factor } (F) = \frac{t_{300} - t_{200}}{t_{200} - t_{100}}$$

wherein:

$t_{100}$ is the time required for passing 0 to 100 ml;

$t_{200}$ is the time required for passing 0 to 200 ml; and $t_{300}$ is the time required for passing 0 to 300 ml.

Generally speaking, the value $F<1.5$ indicates good filtration.

The screen factor to be determined in the following examples is empirically correlated with the resistance factor of core tests and is represented by the ratio of the time required for passing the polymer solution to that for passing its solvent as shown in the following expression. The time required for passage is measured by means of a screen viscosimeter which has about 30 ml of glass bulb at the upper portion thereof and 5 sheets of 100 mesh screens of stainless steel packed in a tube of 0.25-inch inner diameter at the lower portion thereof.

$$\text{Screen factor} = \frac{\text{time required for passing a polymer solution (second)}}{\text{time required for passing its solvent (second)}}$$

EXAMPLE 1

Partially hydrolyzed acrylamide polymer powder (maximum particle size 18 mesh) having a molecular weight of $18\times10^6$ and a degree of hydrolysis of 13 mol % is conveyed by nitrogen gas flow to the powder storage tank 3. By means of the constant powder supply device 4 shown in FIGS. 2 through 4, the polymer is sent at a rate of 150 kg/hr for 30 minutes together with nitrogen gas blown downward (from the blowing port 110) into the dispersion device (of polyvinyl chloride resin) shown in FIGS. 5 and 6 and is dispersed and dissolved in an aqueous solution of 3% by weight sodium chloride (flow rate 15 $m^3$/hr$\times$30 minutes), so that a polymer concentration of 0.5% by weight is obtained.

The resulting dispersion or solution is sent to a sealed dissolution tank (rubber-lined iron tank) having an effective capacity of 7.5 $m^2$ and is agitated at a peripheral velocity of 1.2 m/sec. for 2 hours by an agitator (of 316 stainless steel), whereby the dissolution is completed. The resulting solution is filtrated in an 80-mesh strainer (of 316 stainless steel) and then sent by a Mono pump (comprising a stator of 316 stainless steel and a rotor of synthetic rubber) to a sealed storage tank (a rubber-lined iron tank) having an effective capacity of 10 $m^3$.

In an actual instance, all of these steps were carried out under nitrogen gas atmosphere. Sampling was carried out on the way from the storage tank to a line-mixing portion installed in the path of injection pipe. The sample was diluted with the above-mentioned solution to a concentration of 0.05% by weight of the polymer and was subjected to measurement at room temperature to obtain desired values of filtration factor=1.1, viscosity=4.4 cps (6.9 sec.$^{-1}$), and screen factor=53.

EXAMPLE 2

An acrylamide copolymer powder (maximum particle size 16 mesh) having a molecular weight of $6\times10^6$ and having a mole ratio of acrylamide: methacrylic acid: acrylic acid of 80:5:15 was sent by nitrogen gas pressure to the powder storage tank 3. By means of the constant powder supply device shown in FIGS. 2, 3, and 4, the polymer was sent at 200 kg/hr together with nitrogen gas blown downward into a dispersion device of methacrylic resin and was dispersed in an aqueous solution supplied at 4 $m^3$/hr and containing 3% by weight of sodium chloride, 0.3% by weight of calcium chloride and 100 ppm of formaldehyde (used as a oxygen scavenger) to obtain a concentration of 1.0% by weight, sent to a polyethylene tank of 2 $m^3$ capacity, and then dissolved by agitation at a peripheral velocity of 2 m/sec. for 1 hour.

The resulting solution was sent by a Mono pump (of type 316 stainless steel), filtrated in a 100 mesh strainer, and then sent by a Mono pump of the same type to a storage tank (of polyethylene).

All of these steps were conducted under nitrogen atmosphere. Sampling was carried on the way from the storage tank to a line-mixing portion installed in the path of injection pipe. The sample was diluted with the above-mentioned solution to a concentration of 0.05% by weight of polymer and was subjected to measurement at room temperature to obtain desired values of the filtration factor=1.1 (complete dissolution), viscosity=2.1 cps (6.9 sec.$^{-1}$), and the screen factor=7.

What is claimed is:

1. An equipment for dissolving polyacrylamide powder to obtain an aqueous solution thereof for enhanced oil recovery which comprises the following equipment units (A) through (K):

(A) a first powder storage tank for storing polyacrylamide powder under a nitrogen atmosphere;

(B) a second powder storage tank for storing polyacrylamide powder under a nitrogen atmosphere;

(C) a gas conveyor device for carrying the polyacrylamide powder from the first storage tank to the second storage tank by nitrogen gas flow;

(D) a constant powder supply device connected to receive the polyacrylamide powder supplied from the second storage tank, meter the powder, and discharge the powder, said constant powder supply device comprising a vertical cylinder for receiving the powder, a bottom plate which closes the bottom portion of the cylinder and has an opening portion to allow discharge of a small amount of the powder, a partition plate having an opening portion to allow falling of a small amount of the powder which partition plate is disposed within the cylinder parallel to the bottom plate and over the bottom plate, a driving shaft disposed coaxially in the central portion of the cylinder through the bottom plate and the partition plate, a plurality of radial division plates fixed to the driving shaft in the cylindrical space defined by the bottom plate and the partition plate and designed to rotate in sliding contact with the upper surface of the bottom plate and the lower surface of the partition plate as well as the inner surface of the cylinder, and a rotary powder agitation vane fixed to the driving shaft at the upper portion of the partition plate within the cylinder, the opening portion of the bottom plate for discharging the powder and the opening portion of the partition plate for allowing falling of the powder being disposed apart from the driving shaft, the shapes and positions of these opening portions being so designed that these opening portions do not lie one over another in the vertical direction, communication between these portions being prevented by the division plates;

(E) a powder dispersion device for dispersing in water the polyacrylamide powder discharged from the discharging opening portion of the bottom plate of the constant powder supply device, said powder dispersion device comprising a vessel, a water supply pipe connected to a side portion of the vessel for sending water under pressure into the vessel, a powder supply pipe connected to the upper portion of the vessel for supplying the powder into the vessel, a powder and water discharge pipe having a funnel-shaped inlet disposed a suitable height from the bottom portion of the vessel and being installed coaxially with the powder supply pipe, and an overflow pipe connected to the vessel for discharging water supplied in excess, the vessel and the water supply pipe being so designed that water whirls around the discharge pipe within the vessel, and means for adding additional water under pressure comprising an annular room surrounding the discharge pipe at a location downstream from the funnel-shaped inlet thereof, and another water supply pipe connected to the annular room to supply water under pressure in the tangential direction into the annular room, the discharge pipe having continuous or discontinuous spaces bored therearound so that water is introduced thereinto from the annular room;

(F) a first liquid transfer device for transferring the dispersion or solution of the polyacrylamide powder obtained from the powder dispersion device;

(G) a dissolution tank for receiving the dispersion or solution of polyacrylamide powder thus transferred by the first liquid transfer device and for completing dissolution of the polyacrylamide;

(H) a second liquid transfer device for transferring the polyacryalmide solution from the dissolution tank;

(I) a solution storage tank for storing the polyacrylamide solution thus transferred by the second liquid transfer device;

(J) a filtration device provided in the liquid supply line between the dissolution tank and the solution storage tank; and (K) a nitrogen gas supply system for maintaining the interiors of said units, wherein the polyacrylamide powder or the dispersion or solution thereof is present, filled with nitrogen gas at a pressure higher than atmospheric pressure.

* * * * *